US006805619B2

(12) United States Patent
Carbone

(10) Patent No.: US 6,805,619 B2
(45) Date of Patent: Oct. 19, 2004

(54) KNIFE SHARPENING SYSTEM

(76) Inventor: Martin R. Carbone, 1227 Debo Vista St., Santa Barbara, CA (US) 93101

( * ) Notice: Subject to any disclaimer, the term of this patent is extended or adjusted under 35 U.S.C. 154(b) by 0 days.

(21) Appl. No.: 09/909,353

(22) Filed: Jul. 18, 2001

(65) Prior Publication Data

US 2002/0022443 A1 Feb. 21, 2002

Related U.S. Application Data

(60) Provisional application No. 60/218,868, filed on Jul. 18, 2000.

(51) Int. Cl.[7] ..... B24B 7/00

(52) U.S. Cl. ..... 451/164; 451/356; 451/367; 451/557

(58) Field of Search ..... 451/162, 163, 451/349, 371, 164, 356, 367, 557

(56) References Cited

U.S. PATENT DOCUMENTS 3,126,675 A * 3/1964 McEwan ..... 451/141
3,726,047 A * 4/1973 Long ..... 451/421
3,755,970 A * 9/1973 Parr ..... 451/163
4,602,531 A * 7/1986 Korhonen ..... 76/82
4,731,953 A * 3/1988 Owen ..... 451/163
5,462,476 A * 10/1995 Bohn ..... 451/558
5,582,535 A * 12/1996 Friel ..... 451/45
5,893,792 A * 4/1999 Scott ..... 451/45
6,168,509 B1 * 1/2001 Presgrove ..... 451/552

* cited by examiner

*Primary Examiner*—M. Rachuba
(74) *Attorney, Agent, or Firm*—Christie Parker & Hale, LLP

(57) ABSTRACT

A knife sharpening system for sharpening blade edges of knives. The knife sharpening system includes a base portion having an elongate guide rail having a top surface at a first level, a knife support for maintaining a blade of a knife being sharpened with its blade edge spaced apart by a horizontal distance from the guide rail and for elevating the blade on a plane at a second level which is higher than the top surface of the guide rail. A sharpening implement that is longer than the distance between the guide rail and the blade edge is provided, and placed on the blade's edge and the guide rail, and is moved thereacross to sharpen the knife edge.

13 Claims, 5 Drawing Sheets

KNIFE SHARPENING SYSTEM

CROSS-REFERENCE TO RELATED APPLICATION(S)

This application claims priority of provisional application No. 60/218,868, filed on Jul. 18, 2000.

BACKGROUND OF THE INVENTION

The invention relates to knife sharpening systems, and more particularly to knife sharpening systems which are matched to particular knives so that the knives can be resharpened by a user.

Knives have been used and sharpened since prehistoric times. Modern knives having finely angled edges are difficult to sharpen and maintain by average unskilled persons. Sharpening at too steep of an angle will dull a knife because the edge of the knife is partially removed. On the other hand, sharpening at an angle that is not steep enough accomplishes nothing because the edge of the knife is essentially untouched by the sharpening device. The variety of knives having various lengths, shapes, knife-edge angles, and presence or absence of serrations make it very difficult for the unskilled user to properly sharpen a variety of knives.

There accordingly remains a need for a tool for sharpening particular knives which can also serve as a storage device for the knives.

SUMMARY OF THE INVENTION

The knife sharpening system of the invention provides a base upon which a knife or knives can be placed and preferably engaged, a guide rail spaced an appropriate distance apart from the edge of the knife placed on the base and having a top surface at a lower level than the level of the knife blade placed on the base. When a sharpening implement, such as a sharpening stone, is rested on the guide rail and on the knife's edge and is moved across the guide rail and the knife's edge, an appropriate sharpening angle is placed on the knife. The guide rail will preferably follow the contour of the knife's edge from the tip of the knife to the edge of the knife closest to the handle so as to maintain an appropriate sharpening angle from the tip to the base of the knife, but could be spaced apart by different distances.

The knife sharpening system of the invention preferably has a means to secure the handle of the knife in place and support the blade during sharpening, which knife sharpening system can also serve as a storage tool for the knife when not in use.

These and other aspects of the invention will be described in greater detail below.

DETAILED DESCRIPTION OF THE INVENTION

Figure 1:
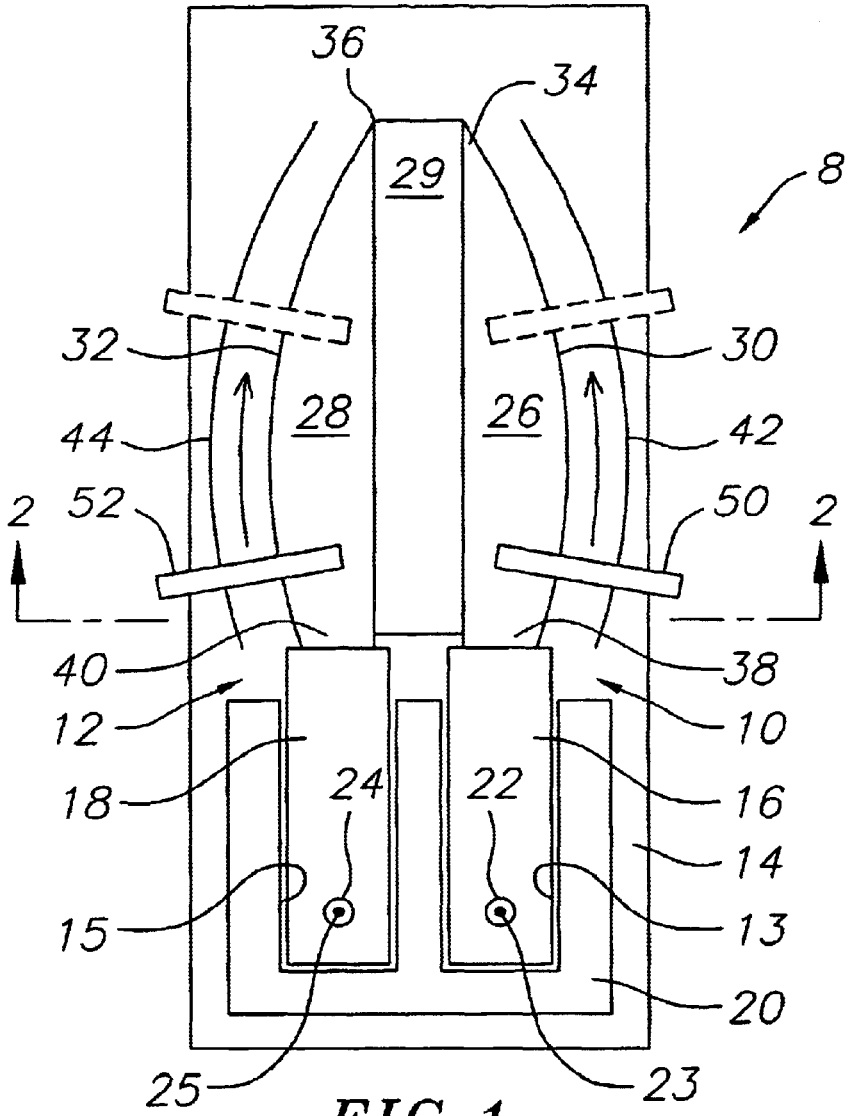
FIG. 1 is a top plan view showing a first embodiment of a knife sharpening system of the invention.

FIG. 1 is a top plan view showing two identical knives 10 and 12 placed on a base (cradle) portion 14 of the knife sharpening system 8 of the invention. The knife handles 16 and 18 are preferably retained in a handle holder portion 20. Knife handles 16 and 18 can have apertures 22 and 24, respectively, formed therein for engagement with pegs 23 and 25 extending from the handle holder portion 20 to secure the knives in place during sharpening. Alternate retention means can be used to retain the knives in place during sharpening and/or storage. Handle holder portion can optionally have handle reliefs 13 and 15 formed thereon to receive handles.

The blade 26 and 28 of knives 10 and 12, respectively, lay on a raised blade platform 29, and edges of the knives 30 and 32 extend beyond side edges 33 and 35 of platform 29.

Figure 2:
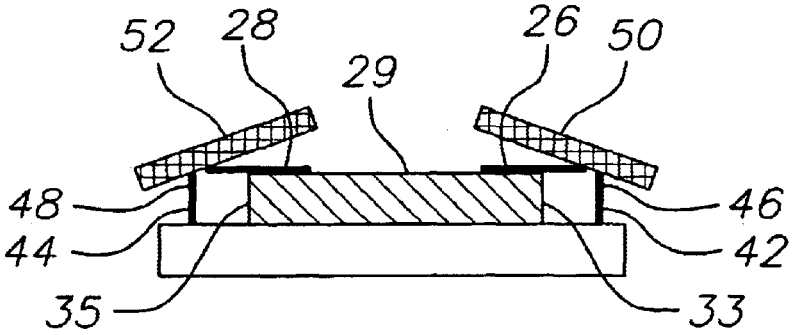
FIG. 2 is a cross-sectional view of the knife sharpening system of FIG. 2 through view lines 2—2.

Blades have tips 34 and 36 and portions 38 and 40 adjacent to handles 16 and 18. A pair of guide rails 42 and 44 are positioned a distance spaced apart from the blade edges 30 and 32, respectively. As shown in FIG. 2, the top edges 46 and 48 of rails are lower than the level of blades 26 and 28. When a sharpening stone or other sharpening means 50 and 52 is placed on the guiding rails 42 and 44 and knife edges 30 and 32, by moving the sharpening means 50 and 52 along the length of the blade, a consistent sharpened edge at a desired angle can be placed on the blades. The guide rails 42 and 44 are made of resilient material, preferably metal, e.g. 0.3 mm (⅛ inch) wide steel. The base, handle holder, blade platform can preferably be formed for metal, plastic, wood, or other materials, and can be unitary. Although shown with two separate knives 10 and 12, in fact, they could be a single knife being flipped over and sharpened on both sides. Through continued use, the guide rails 42 and 44 will be ground as well as the knife edge. This is acceptable and will not significantly alter the sharpened blade angle placed on the knife.

Figure 3:
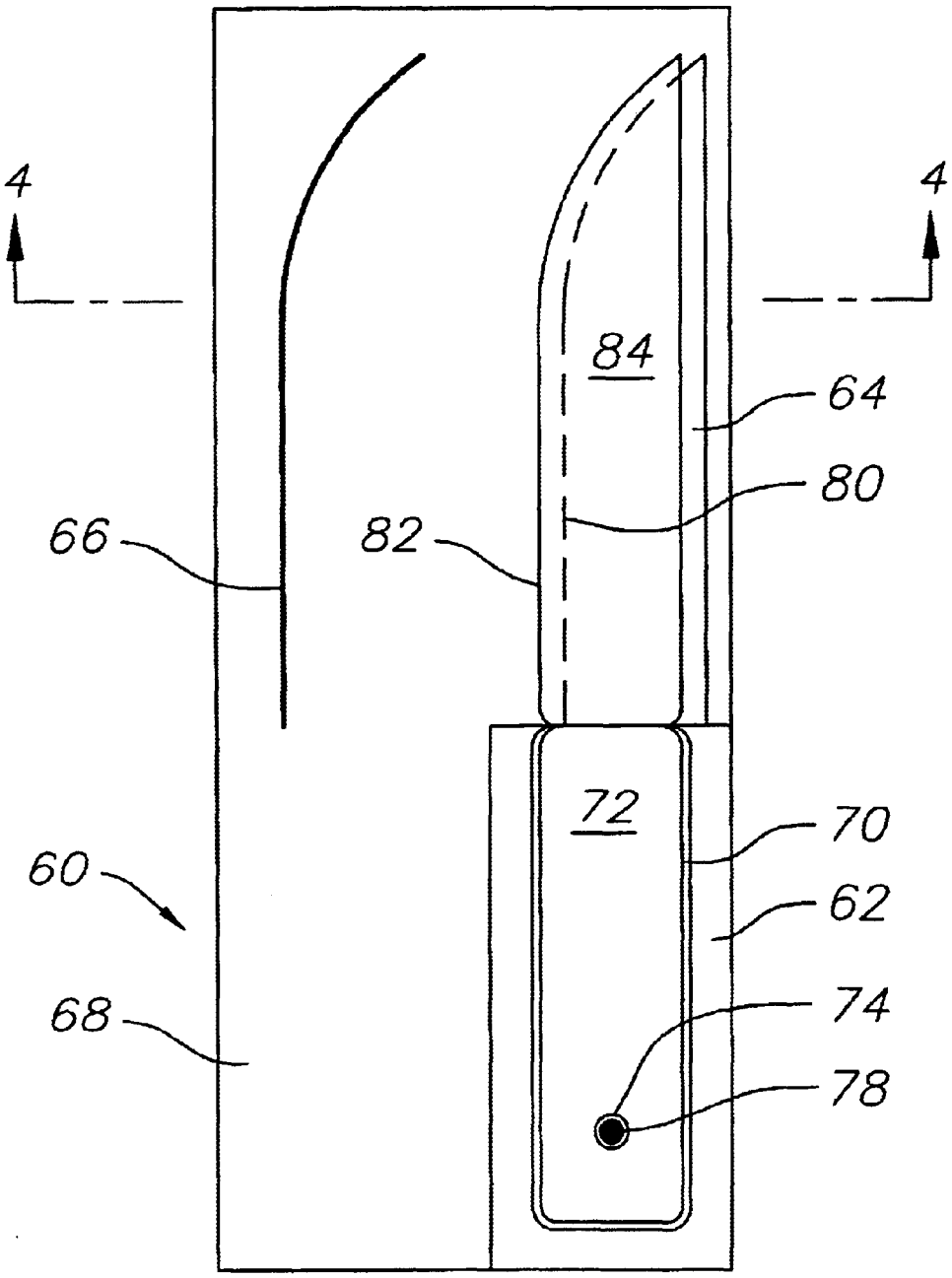
FIG. 3 is a top plan view showing a second embodiment of a knife sharpening system of the invention.

Referring to FIG. 3, there is shown another embodiment 60 of the knife sharpening system, comprising a base 60, a handle support 62, a raised blade platform 64, and a guide rail 66, connected to a base 68. Except for the rail 66, the other parts can be unitary, e.g. shaped from wood, plastic, etc. Handle support 62 preferably has a relief 70 formed therein, sized to receive a handle 72 of knife. Optionally, a peg 78 can be provided that is adapted to engage with an aperture 74 formed in handle. As shown, blade platform 64 has a front edge 80 which is set back slightly from an edge 82 of knife blade 84.

Figure 4:
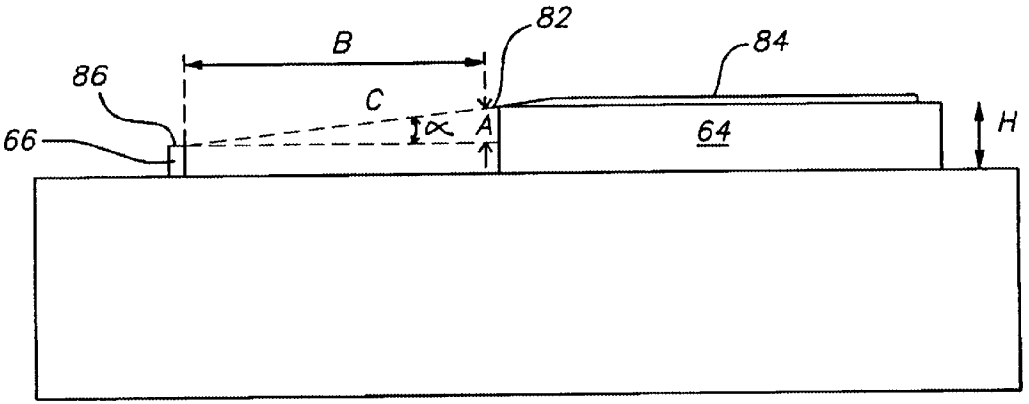
FIG. 4 is a cross-sectional view of the knife sharpening system of FIG. 3 through view lines 4—4.
Figure 8:
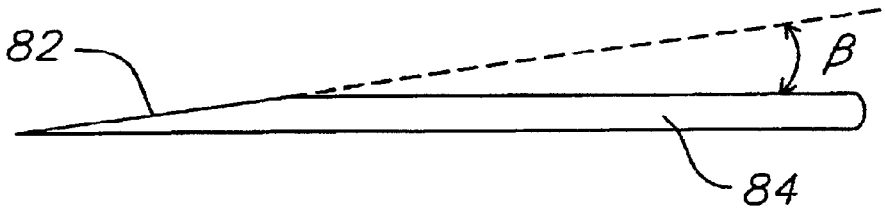
FIG. 8 shows the angle $\beta$ formed on edge of knife.

FIG. 4 is a side view of the holder and knife of FIGS. 3 taking through view lines 4—4 of FIG. 3 and shows knife blade 84 sitting on blade platform 64 and guide rail 66 extending upwardly from platform 68 and spaced a horizontal distance B away from knife blade 82. A top surface 86 of guide rail is vertically lower by distance A from level of knife blade. The distance from knife blade 82 to top edge 86 of guide rail is distance C and is sloped at angle $\alpha$. By adjusting distances A and B, angle $\alpha$ can be selected to be appropriate to establish the correct knife edge 82 on knife blade. Angle $\alpha$ is preferably set to be that of knife blade angle $\beta$ as shown in FIG. 8. Other desired angles $\alpha$ can be set.

Figure 5:
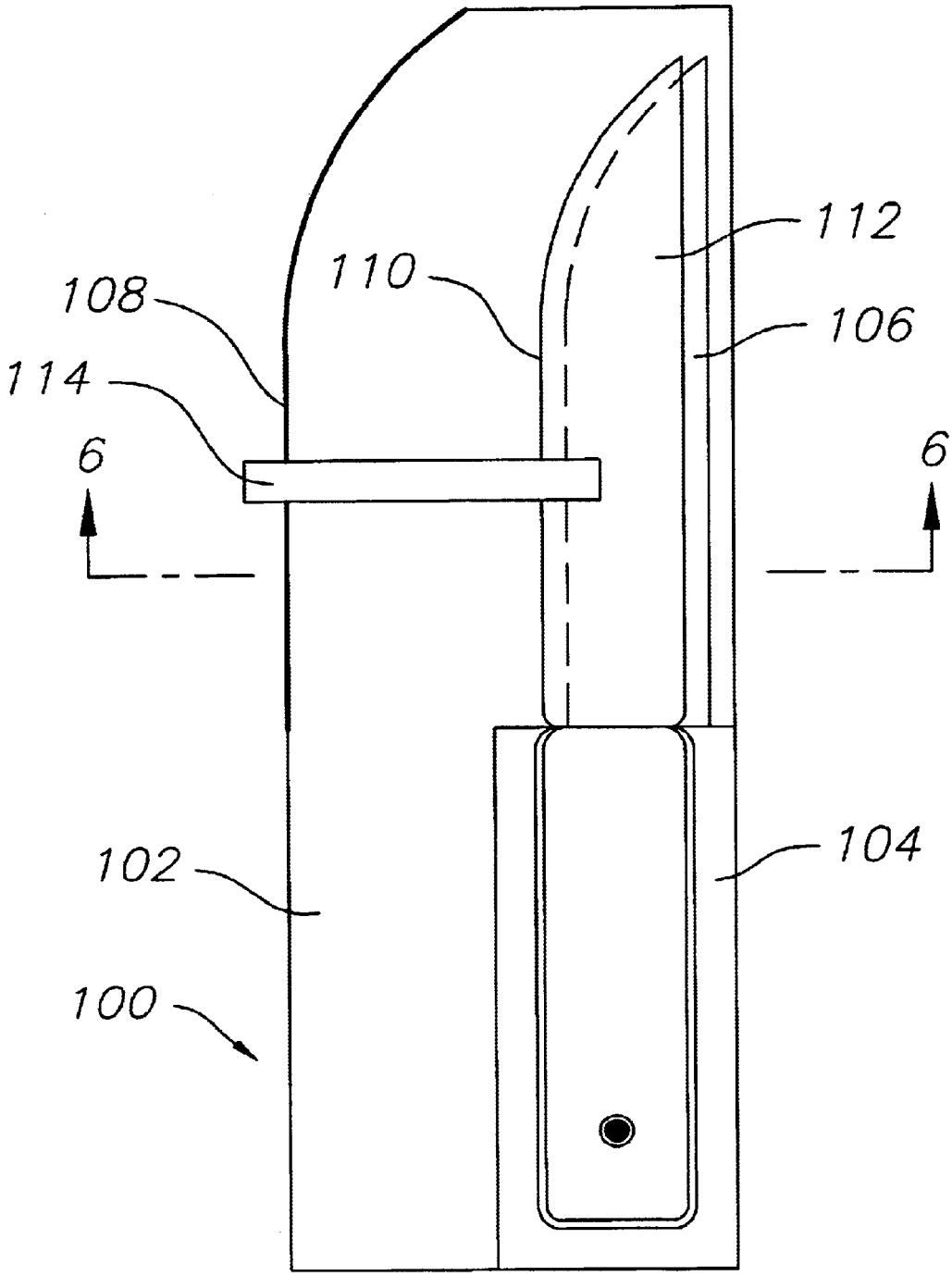
FIG. 5 is a top plan view showing a third embodiment of a knife sharpening system of the invention.

Turning to FIG. 5, there is shown a second embodiment 100 of a knife sharpening system of the invention. It comprises a base 102, a handle platform 104, a blade platform 106 and a guide rail 108 which is imbedded into a portion one edge of the base 102 opposite a blade edge 110 of a knife 112.

Figure 6:
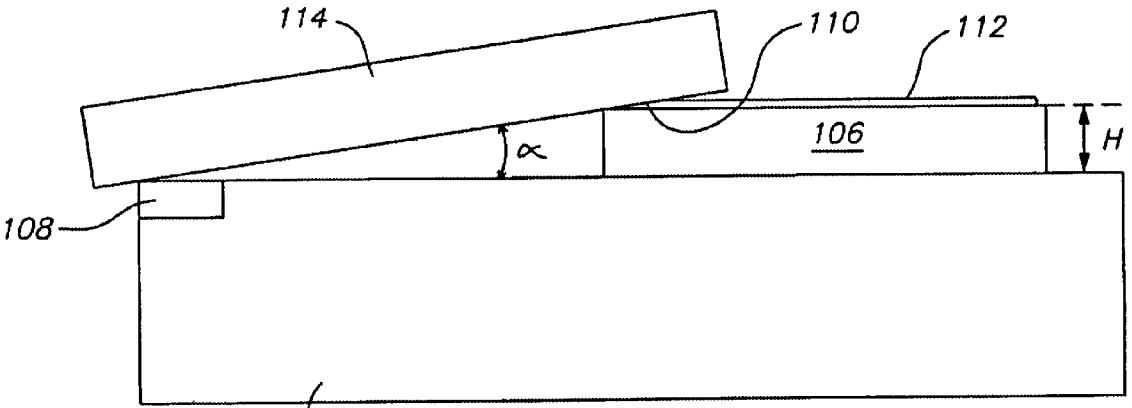
FIG. 6 is a cross-sectional view of the knife sharpening system of FIG. 5 through view lines 6—6.
Figure 7:
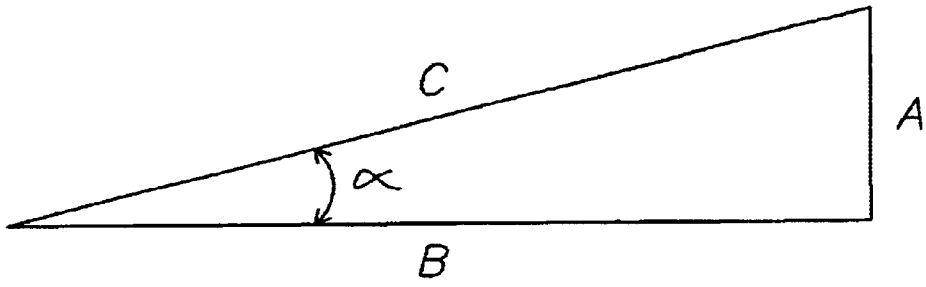
FIG. 7 shows angle $\alpha$ determination of the device.

FIG. 6 is a side view thereof and shows the guide rail 108 and blade platform 106 upon which blade 112 rests. When a sharpening tool 114 is used, it will ride on guide rail 108 and edge 110 of knife blade 112 at an angle $\alpha$. This relationship is shown in FIG. 7 wherein the lengths A, B and C determine the angle $\alpha$ as follows: $\tan^{-1} A/B=\alpha$, which will be the resulting sharpened blade angle $\beta$, which is shown in FIG. 8. $\alpha$ and $\beta$ will be the same angle, or very close.

The method of using the knife sharpening system of the invention is as follows. First, a knife is sharpened at its place of manufacture to a predetermined edge angle prior to use. When the knife needs sharpening, it is then placed by the user in the cradle/holder. The user will take a sharpening means, such as a hand-held sharpening stone, and place it across the gap between a knife edge to be sharpened and the guide rail. In an approximately perpendicular position to each supporting edge, the sharpening surface will then be moved across the knife edge and rail in any motion pattern (e.g. circular, sliding, etc.) keeping in contact with the edge of both the guide rail and a knife edge. If it is desired to put an edge on both sides of a knife blade, (which can be done with the embodiment shown in FIGS. 1 and 2), the knife can be flipped over and this can be repeated for the other edge.

For straight edged blades, the rail would be straight. The device could be used to sharpen serrated blade, although the sharpening would primarily occur in the tips of the serrations.

The knife sharpening system can be included along with knives for which the knife sharpening system is set up to work with as a set. In this manner, a user can keep his or her knives sharp at all times.

Having thus described exemplary embodiments of the present invention, it should be understood by those skilled in the art that the above disclosures are exemplary only and that various other alternatives, adaptations and modifications may be made within the scope of the present invention. The presently disclosed embodiments are to be considered in all respects as illustrative and not restrictive. The scope of the invention being indicated by the appended claims, rather than the foregoing description, and all changes which come within the meaning and range of equivalency of the claims are, therefore, intended to be embraced therein.

What is claimed is:

1. A knife sharpening system for sharpening blade edges of knives, comprising: a base portion having an elongated guide rail, a top surface at a first level, a knife support means for maintaining a blade of a knife being sharpened with its blade edge spaced apart by a horizontal distance from the guide rail and for elevating the blade on a plane at a second level which is higher than the top surface of the guide rail and a handle support for engaging a handle of the knife; and a sharpening implement which contacts and is guided on the guide rail for movement relative to the blade and which is longer than the distance between the guide rail and the blade edge.

2. The knife sharpening system of claim 1, wherein the handle support has a relief for receiving a handle of the knife.

3. The knife sharpening system of claim 1, wherein the handle support has a peg for engagement with a peg receiving aperture in a handle of the knife.

4. The knife sharpening system of claim 1, wherein the base portion has a blade platform upon which the blade of the knife will sit.

5. A sharpening system for sharpening blade edges of knives comprising: a base portion having two elongate guide rails, each with a top surface at a first level, a knife support means for maintaining a blade of the knife being sharpened with its blade edge spaced apart by a horizontal distance from the guide rail and for elevating the blade on a plane at a second level which is higher than the top surface of the guide rail, and wherein the knife support means will support the knife in two, flipped over orientations; and a sharpening implement which contacts and is guided on the guide rail for movement relative to the blade and which is longer than the distance between the guide rail and the blade edge.

6. A knife sharpening system for sharpening blade edges of knives, comprising a base portion having an elongated guide rail with a top surface at a first level, wherein the guide rail is curved to match a curved knife which the knife sharpening system is used to sharpen, a knife support means for maintaining a blade of the knife being sharpened with its blade edge spaced apart by a horizontal distance from the guide rail and for elevating the blade on a plane at a second level which is higher than the top surface of the guide rail; and a sharpening implement which contacts and is guided on the guide rail for movement relative to the blade and which is longer than the distance between the guide rail and the blade edge.

7. The knife sharpening system of claim 1, wherein the sharpening implement is a sharpening stone.

8. The knife sharpening system of claim 1, wherein the sharpening implement sits on the blade at a predetermined sharpening angle.

9. A knife sharpening system for sharpening blade edges of knives, comprising: at least one knife having a predetermined handle and blade size, shape, and blade edge angle; a base portion having an elongate guide rail having a top surface at a first level, a knife support means for maintaining a blade of the knife being sharpened with its blade edge spaced apart by a horizontal distance from the guide rail and for elevating the blade on a plane at a second level which is higher than the top surface of the guide rail and a handle support for engaging a handle of the knife; and a sharpening implement which contacts and is guided on the guide rail for movement relative to the blade and which is longer than the distance between the guide rail and the blade edge.

10. The knife sharpening system of claim 9, wherein the handle support has a relief for receiving the handle of the knife.

11. The knife sharpening system of claim 9, wherein the knife has an aperture formed in its handle, and the base portion has a peg for engagement with the aperture.

12. The knife sharpening system of claim 9, wherein the base portion has a blade platform upon which the blade of the knife will sit.

13. The knife sharpening system of claim 9, wherein the base portion has two guide rails and the knife support means will support a knife in two, flipped over, orientations.

* * * * *